US005875879A

United States Patent [19]

Hawthorn

[11] Patent Number: 5,875,879

[45] Date of Patent: Mar. 2, 1999

[54] COIN OPERATED MACHINE HAVING AN ELECTRONICALLY IDENTIFIED COIN COLLECTION BOX

[76] Inventor: Nate D. Hawthorn, 3923 Avila, Las Vegas, Nev. 89103

[21] Appl. No.: 824,731

[22] Filed: Mar. 26, 1997

Related U.S. Application Data

[63] Continuation-in-part of Ser. No. 675,899, Jul. 5, 1996, abandoned.

[51] Int. Cl.[6] ..... G07F 9/06

[52] U.S. Cl. ..... 194/350; 902/9; 232/15

[58] Field of Search ..... 194/202, 215, 194/216, 217, 350; 453/17; 232/7, 12, 15, 16; 902/9, 12, 13

[56] References Cited

U.S. PATENT DOCUMENTS

| | | | |
|---|---|---|---|
| 2,371,114 | 3/1945 | Von Stoeser | 232/15 |
| 4,283,709 | 8/1981 | Lucero et al. | 235/375 X |
| 5,056,643 | 10/1991 | Kirberg | 194/202 |
| 5,224,579 | 7/1993 | Brown | 194/350 |
| 5,259,491 | 11/1993 | Ward II | 194/350 |
| 5,458,285 | 10/1995 | Remien | 232/15 |
| 5,619,932 | 4/1997 | Efland et al. | 194/350 |

FOREIGN PATENT DOCUMENTS

| | | | |
|---|---|---|---|
| 2230371 | 10/1990 | United Kingdom | 194/350 |

*Primary Examiner*—F. J. Bartuska
*Attorney, Agent, or Firm*—Terrance L. Siemens

[57] ABSTRACT

A coin operated machine, preferably a gaming machine for a casino but also including vending machines, having a removable coin collecting box and electronic memory for associating the box with the machine to enable subsequent reconciling of accounts. Both machine and box are provided with respective memory devices. The machine and the box have complementing structure for positioning the box accurately and appropriately within the machine, the structure allowing the box to be inserted reversibly. This structure comprises a tapered projection formed in the machine and cooperating, closely fitting walls surrounding the projection, formed in the box. Electrodes enabling communication between the memory devices are disposed upon contacting surfaces of the box and the projection. In alternative embodiments, the electrodes have sliding contacts, induction coils, or radio transmission apparatus for completing communication circuits.

15 Claims, 4 Drawing Sheets

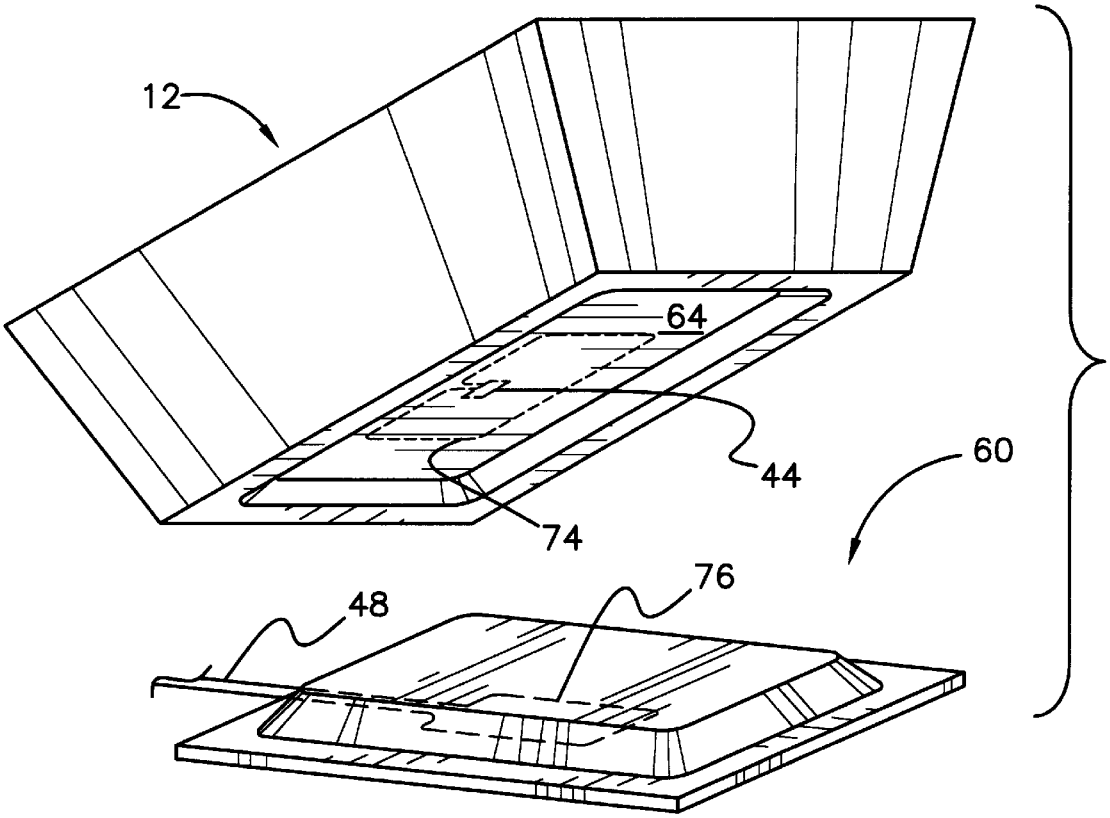
FIG. 5
FIG. 6
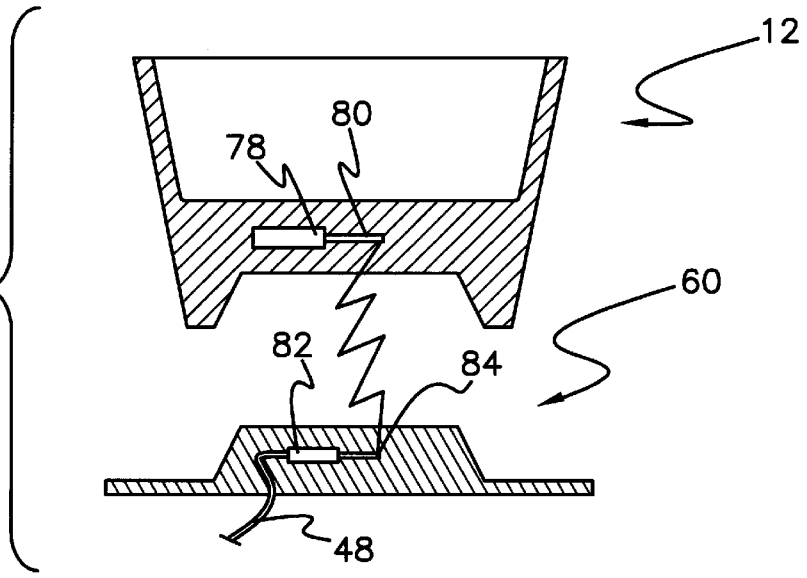

COIN OPERATED MACHINE HAVING AN ELECTRONICALLY IDENTIFIED COIN COLLECTION BOX

REFERENCE TO RELATED APPLICATION

This application is a Continuation-In-Part of Ser. No. 08/675,899, filed Jul. 5, 1996 now abandoned.

BACKGROUND OF THE INVENTION

1. Field of the Invention

The present invention relates to a coin receiving box associated with operation of a host coin accepting machine. The coin collection box is removable from the machine, and is interchangeably inserted selectively into any one of several similar machines. The coin box contains memory for establishing both temporary and permanent electronic records, and has electrical contact surfaces enabling communication with its host machine. The coin box has guiding structure for assuring that it is correctly inserted into its host machine. Both the guiding structure and the electrical contacts enable reversible insertion into the host machine.

2. Description of the Prior Art

Certain activities, such as vending and gaming, are available to the public in commercial premises dedicated to these activities. These premises contain gaming machines which operate automatically when a patron inserts coins or tokens into the machine. Gaming machines tend to amass coins or tokens rapidly, and must periodically be emptied. Since machine operation is equally feasible with coins and tokens, discussion from this point forward will refer to coins, it being understood that tokens may be substituted to similar effect.

In particular, gaming machines are available in large numbers in casinos. Large numbers of people enjoy using these machines, which may all be in use despite the number of machines available. To enable rapid reestablishment of operability after retrieval of coins, gaming machines are provided with interchangeable, removable coin collection boxes. Service personnel employed by the casino come to a gaming machine with an empty coin collection box, remove the full box, and insert the new box. The full box is then brought to a counting facility for accounting and verification of its contents.

Many boxes may be present simultaneously at the counting facility. Various schemes have been employed to enable the casino to know which box is associated with which gaming machine. These schemes use printed numbers on small pieces of paper, or serial numbers printed on the side of coin boxes. Both methods are prone to human error and mistake.

The casino may easily fail to recover all coins which theoretically are present in the coin box. Such loss may stem from either of two possibilities. One is that the bin was misaligned within its host gaming machine, so that some coins could fail to enter the box. In this case, the coins could lodge within recesses in the machine, or be retrieved and pocketed during removal of the box by dishonest personnel servicing the machine. These personnel may also remove coins from the interior of the box, even when the coins have properly entered the box.

Although casinos have automated systems utilizing the master computer for calculating a total sum which theoretically has been amassed by the machines, the system falls short of being able to pinpoint specific causes of loss. This is because large numbers of coin or token bins are received at the counting facilities, and it is not possible to identify which box was short of its calculated receipts. It is merely possible to calculate that the sum of the coins actually collected falls short of theoretical receipts. Thus the operator of the premises cannot identify poorly installed bins and dishonest employees.

A coin receiving machine having a removable coin collection box and electronic memory devices contained within both machine and box is shown in U.S. Pat. No. 5,056,643, issued to Bernd Kirberg on Oct. 15, 1991. Kirberg's device is a vending machine rather than a gaming machine, and lacks the arrangement of guiding structure assuring appropriate and reversible mating of the coin collection box within the host machine and electrical contacts found in the present invention.

Mechanical disconnection of an electronic memory device within a coin receiving machine upon removal of a coin collecting receptacle is shown in U.S. Pat. No. 5,485,285, issued to Jerome Remien on Oct. 17, 1995. Remien's machine is not a gaming machine, and lacks the arrangement of guiding structure assuring appropriate and reversible mating of the coin collection box within the host machine and electrical contacts found in the present invention.

Keyed insertion of a coin collecting receptacle into a host machine is exemplified in U.S. Pat. No. 2,371,114, issued to Walter Von Stoeser on Mar. 6, 1945. Stoeser's arrangement does not allow for reversible insertion of the receptacle, as provided in the present invention. Also, Stoeser's machine is not a gaming machine, and lacks electronic memory and electrical contacts enabling communication to electronic memory, as found in the present invention.

None of the above inventions and patents, taken either singly or in combination, is seen to describe the instant invention as claimed.

SUMMARY OF THE INVENTION

The present invention provides structural cooperation between a coin collecting box and its host machine so that the box is reversibly insertable into the host machine and so that accurate positioning of the box within the host machine is assured. The coin box and the cavity of the host machine are each provided with complementary grooves or projections assuring appropriate alignment of the box.

A preferred configuration of guiding members includes a low upwardly oriented projection disposed upon the flat floor of the cavity of the host machine. The coin box has a flat floor including short depending walls which partially surround and closely cooperate with the projection when the coin box is fully inserted and lowered into position. Both the projection of the host machine and the walls of the coin box are inclined, so that lowering the coin box also centers the coin box over the projection. The coin box is configured to avoid cracks and crevices into which coins may lodge, be concealed, or otherwise be lost.

The host machine and the coin box are each provided with electronic memory devices for storing information relating to the identity of each and with circuitry enabling communication between the two memory devices. Each memory device receives information relating at a minimum to cumulative count of coins and to the identity of its partner. Therefore, when the coin box is returned to the counting facility, the operators of the casino may ascertain which coin box has been associated with which gaming machine. Any shortage of coins will be attributable to the correct source of the loss, and remedial steps may then be taken. At the same time, counting and verification of other machines and coin boxes may proceed independently of a short count relating to any one particular coin box.

To enable communication between box and host machine, electrical contacts are provided in each such that they will be operable regardless of direction of insertion of the coin box into the host machine. The communication circuits completed by mating of these contacts are separable, or broken when the coin box is removed. Contact is preferably sliding in nature rather than depending upon interfering abutment. Effective contact may then ensue without requiring the extreme precision required for abutting contact.

The arrangement of the contacts reduces requirements for precision when mating. Unlike connection devices such as multipin connectors, which must be carefully aligned prior to mutual engagement, the electrical contacts act automatically, requiring no attention from the installing personnel whatsoever. Physical alignment of the coin box within the cavity of the host machine is the only requirement. Cooperation between the depending walls of the coin box and the projection of the host machine assures that it is nearly impossible to misalign the two.

The electrical contacts are disposed upon the flat upper surface of the projection of the host machine and upon the flat floor of the coin box. In an alternative to actual contact, communicable engagement may be accomplished by induction. Coils embedded within the box and the host machine on the flat surfaces will cause signals to be transferred inductively without resorting to actual contact.

Accordingly, it is a principal object of the invention to provide a coin receiving machine having a removable coin collection box and electronic memory apparatus for temporarily recording identity of both the machine and the box, so that upon removal of the box and retrieval of its contents, the retrieved contents may be reconciled with records of the sum inserted into the machine.

A second object of the invention is that the box be provided with memory for retaining its identity independently of other memory devices external to the box.

It is another object of the invention that the coin box and the host machine cooperatingly interfit to assure appropriate alignment between the two.

It is a further object of the invention to provide apparatus which will transmit electrical or electronic signals between the coin box and its host machine when the former is correctly installed within the latter, and which will prevent signal transmission when the former is not correctly installed within the latter.

Still another object of the invention is to enable reversible insertion of the coin box within the host machine, while preserving communicable engagement therebetween.

Yet a further object of the invention is to configure the box to avoid construction wherein cracks and crevices are present, and in which cracks and crevices coins may lodge.

An additional object of the invention is to provide cooperating inclined surfaces promoting centering of the coin box within the cavity of the host machine receiving the coin box.

It is again an object of the invention to provide an electronic memory device within both the host machine and the coin box, and separable circuitry for communicating between the two memory devices.

Still another object of the invention is to prevent loss of coins.

Yet another object of the invention is to provide a gaming machine having electronic memory and a readily insertable coin collection box having electronic memory and separable circuitry for communicating between the memory of the collection box and the memory of the gaming machine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 5 is a view similar to that of FIG. 3, but illustrating a first alternative embodiment.

FIG. 6 is a view similar to that of FIG. 4, but illustrating a second alternative embodiment.

DETAILED DESCRIPTION OF THE PREFERRED EMBODIMENTS

Figure 1:
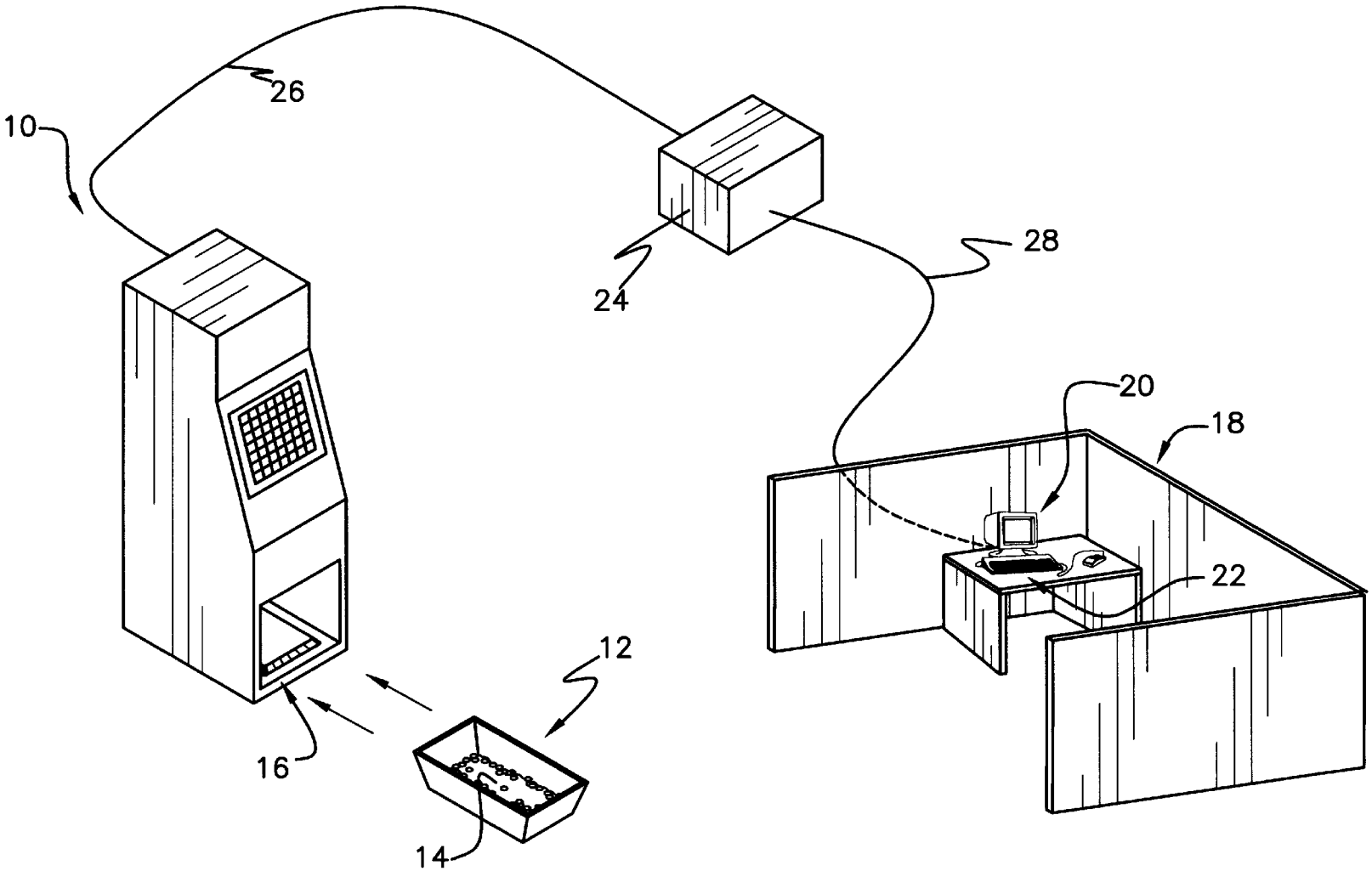
FIG. 1 is a perspective, environmental, diagrammatic view of the invention, showing an application in a casino.

FIG. 1 shows the present invention as it would be employed in a casino (not shown in its entirety). The invention comprises a coin operated machine 10 having a removably insertable coin box 12 for receiving and storing coins 14 inserted into machine 10. Coin box 12 is periodically removed for counting and retrieving coins 14. A similar coin box (not shown) is inserted into a cavity 16 serving as a receptacle for containing coin box 12 when machine 10 is in use. Coin box 12 is designed to be reversibly inserted into cavity 16 in the interests of efficiently replacing coin boxes and expeditiously returning machine 10 to active service.

In a typical casino, coin box 12 is carried on a cart (not shown) together with other coin boxes (not shown) to a counting facility 18 for retrieval of coins and reconciling of accounts. Counting facility 18 has a computer monitor 20 and a keyboard 22. Machine 10 has a memory device (see FIG. 2) which is employed in tracking receipts and disbursements made by machine 10. This information is communicated to a central computer 24, which includes another memory device, by any suitable method, such as by cable 26. Monitor 20 and keyboard 22 communicate with computer 24 by cable 28. Information contained in the two memories further includes data identifying which coin box has served machine 10 during a specified time period. The operator of the casino may thus account for shortages in the count of retrieved coins, and may pinpoint the source of any loss as accruing from pilferage or from mechanical failure. Identities of the personnel removing and returning coin box 12 may also be tracked in the memories.

Figure 2:
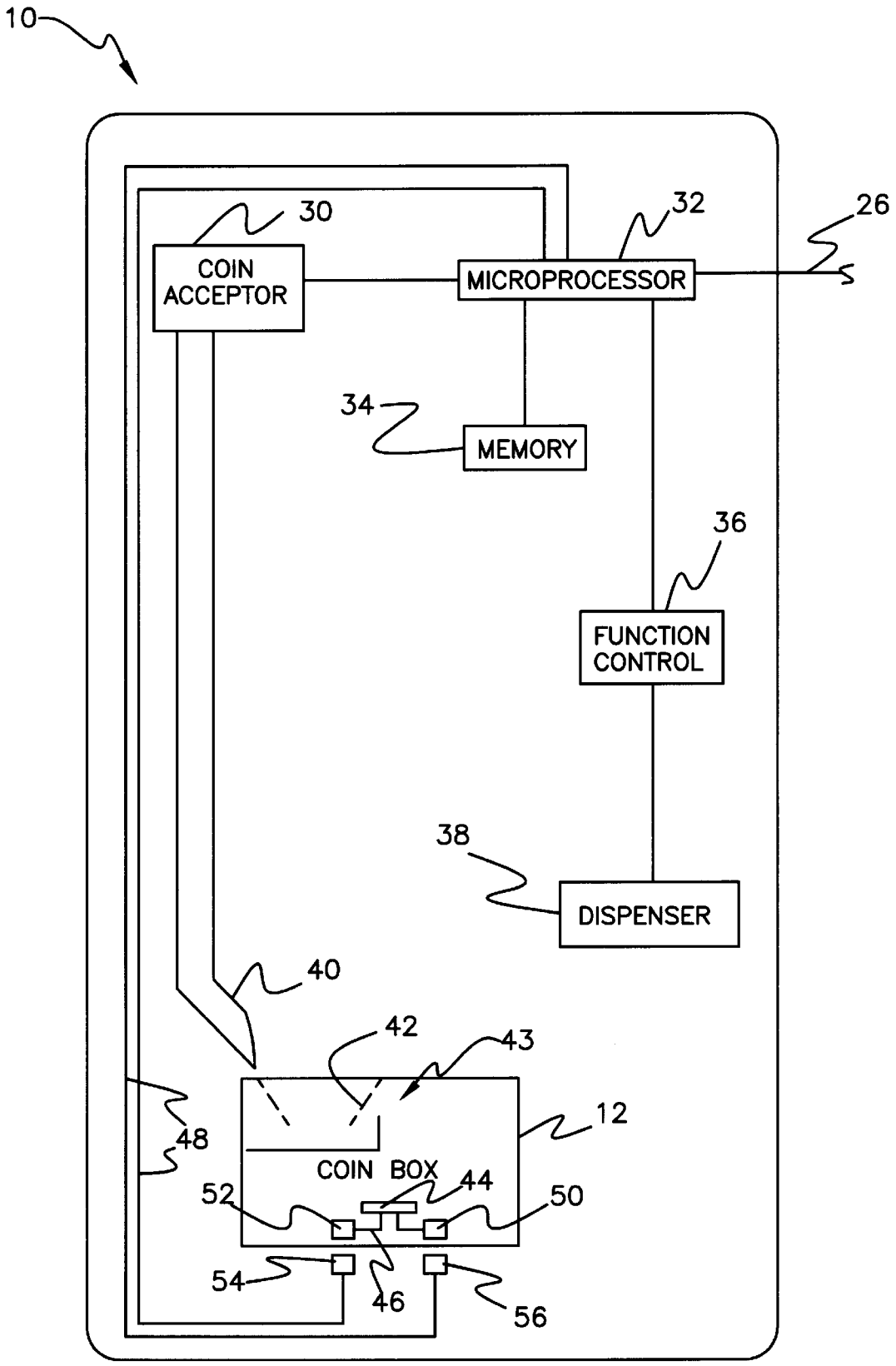
FIG. 2 is a front elevational, diagrammatic view of the invention.

FIG. 2 shows typical components of machine 10. A coin accepting apparatus 30 receives coins, verifies authenticity and value of coins, and sends a signal to a microprocessor 32 enabling activities to proceed if sufficient value has been received. Microprocessor 32 has an associated memory device, such as RAM 34. A function controller 36 is enabled by a signal from microprocessor 32 to accept commands from the patron of machine 10 responsive to acceptance of a coin by coin accepting apparatus 30 and determination of sufficient value for the requested function.

In gaming machines, the function will relate to gaming or gambling. In this case, the function will be performing a calculation of a random chance result, and dispensing a return based upon the chance result. The return, made by a dispenser 38, may be a payoff if the chance result favors the patron, and will result in retention of inserted money by machine 10 if the chance result does not favor the patron.

The present invention is equally applicable to machines performing functions other than gaming. For example, the machine may be a vending machine (not shown). If this were the case, then dispenser 38 would comprise well known apparatus for selecting and dispensing merchandise, and optionally for making change.

Coin box 12 is diagrammatically shown in a predetermined, operative position within machine 10. This signifies that coin box 12 is correctly positioned to successfully receive coins delivered thereinto by machine 10, thereby defeating a potential source of loss. If the function being performed results in a determination that an inserted coin should be retained by machine 10, then that coin is routed to coin box 12. This is indicated diagrammatically by chute 40. Alignment of chute 40 with coin guide 42, which leads to a coin storage receptacle 43, represents the operative position of coin box 12 within machine 10.

Of course, machine 10 may retain coins for potential return to the patron. Apparatus for accomplishing this is well known and may be incorporated for the successful operation of machine 10 if desired.

The operative position further signifies that coin box 12 is properly aligned to assure completion or connection of communications circuitry. It being recalled that coin box 12 has a memory device 44, circuitry 46 is provided to transmit signals to memory device 44. Circuitry 46 is connected to complementary circuitry 48, which complementary circuitry 48 is in turn connected to memory device 34. Final connections are made by electrodes 50, 52 of circuitry 46 and electrodes 54, 56 of circuitry 48. Cable 26 may be regarded as a further component of circuitry 48, and performs the function of transmitting communication signals between microprocessor 32 and its associated memory device 34 and external computer 24 and its associated memory device (not shown apart from computer 24).

An operator may utilize keyboard 22 to query microprocessor 32 of machine 10, in order to receive information from machine 10 prior to receiving coin box 12. The same information available from microprocessor 32 may be entered into memory device 44 of coin box 12. Alternatively, some information may be restricted from memory device 34 or from memory device 44, so that there may be a difference in entered data between these components. Many algorithms or programs may be utilized in controlling and communicating between computer 24 and memory devices 34 and 44, depending upon the exact functions to be performed. These algorithms are well known or may be created especially for the application by those of skill in the art.

Figure 3:
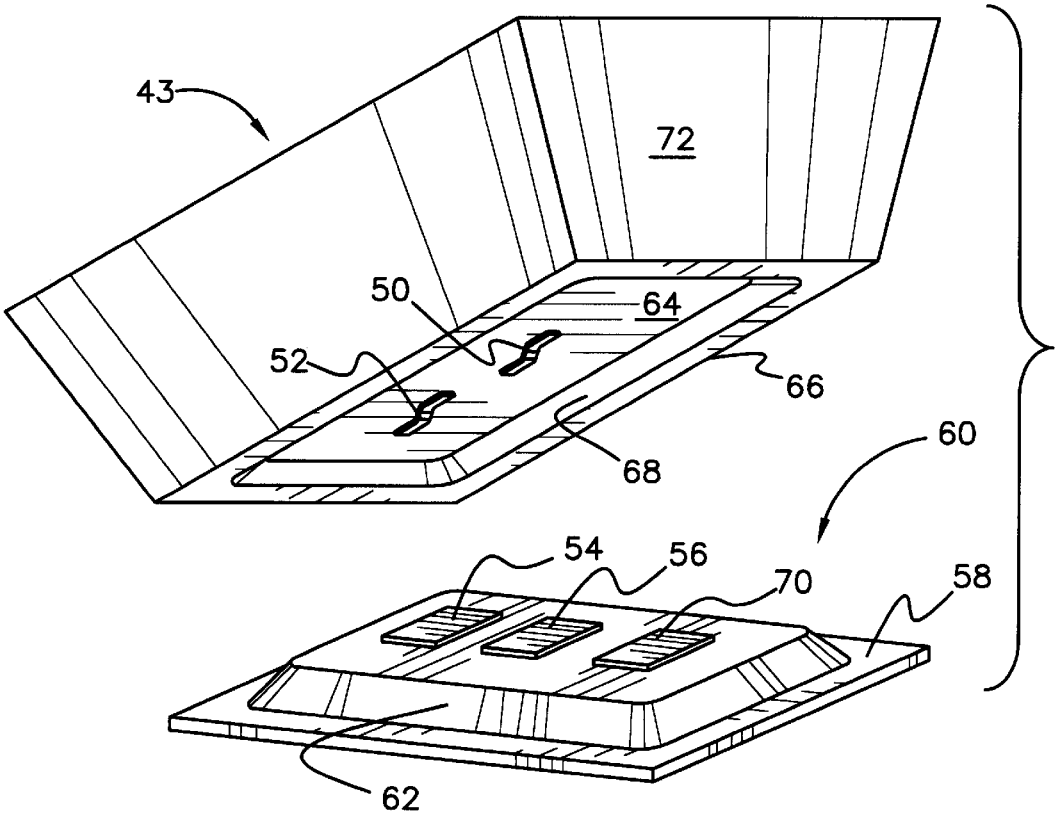
FIG. 3 is an exploded perspective detail view of components seen at the bottom of FIG. 2.
Figure 4:
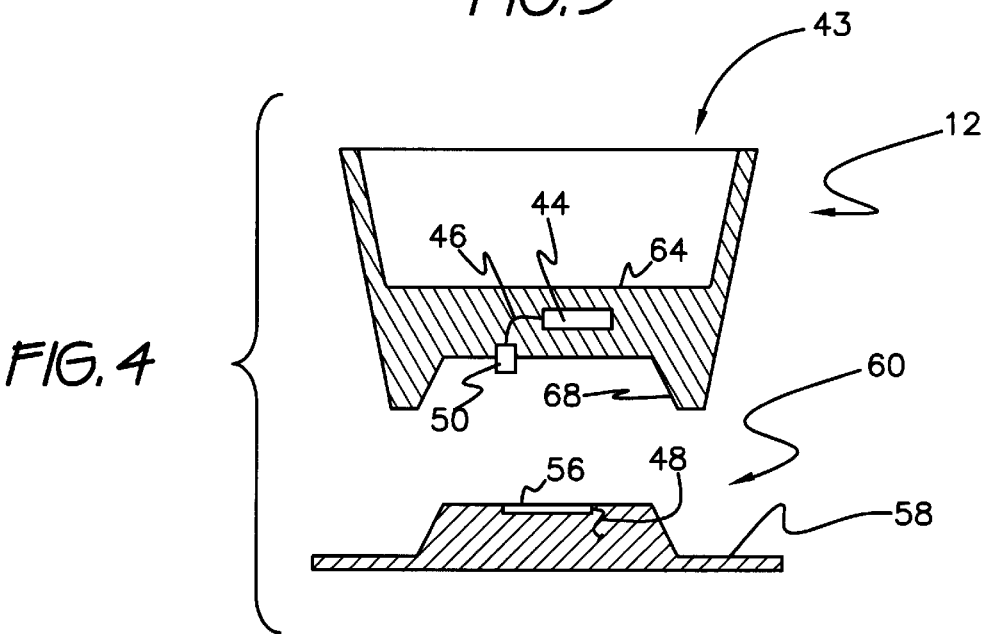
FIG. 4 is a front cross sectional view of the components of FIG. 3.

Interfitting cooperation between coin box 12 and cavity 16 (see FIG. 1) is shown in FIGS. 3 and 4. Cavity 16 has receiving structure for removably receiving and locating coin box 12, comprising a floor 58 and a projection 60 projecting upwardly from floor 58. Projection 60 has an inclined lateral wall 62 which gives projection 60 a tapered configuration wherein the top is smaller than the bottom. Coin box 12 has guiding structure including a bottom panel 64 and a wall 66 depending from bottom panel 64. Wall 66 has an inclined surface 68 complementing and closely cooperating with tapered projection 60.

When coin box 12 is inserted into cavity 16 and released, coin box 12 will be urged by gravity to attain the predetermined position, shown representatively in FIG. 2, beneath chute 40 (see FIG. 2) or equivalent structure for depositing coins into receptacle 43.

In the present example, corresponding inclination of wall 62 and surface 68 urges coin box 12 to become centered over projection 60. Of course, inclination of wall 62 and surface 68 could be reversed to the same effect. In other embodiments (not shown), it would be possible that corresponding receiving structure of a coin operated machine and guiding structure of the coin box be differently configured. For example, the coin box could be urged to the left, right, or to the rear, or to an intermediate position having combined characteristics of these directions.

Electrodes 50, 52 and 54, 56 and their respective alignment are also shown in FIG. 3. Electrodes 50 and 52 are exposed from below panel 64, and will make physical contact with electrodes 54, 56, which are exposed from above projection 60 when coin box 12 is lowered into the predetermined position.

Preferably, contact is sliding contact, rather than requiring penetration and consequent careful alignment of the respective male and female electrodes (not shown). In addition to sliding contact, electrodes 50, 52 and 54, 56 are arranged serially with respect to the direction of insertion of said coin box into said coin operated machine, so that coin box 12 need be moved in a straight line, and not necessarily moved in a complex manner to assure mating of the contacts 50, 52, 54, 56. The relative large size of one of the two sets of electrodes 50, 52 or 54, 56 assures contact even if coin box 12 is slightly misaligned relative to projection 60.

An additional electrode 70 is disposed upon projection 60 and connected in common with electrode 54. This arrangement assures that coin box 12, which is of symmetrical construction, may be inserted into cavity 16 with end wall 72 facing either to the rear of machine 10 or to the front thereof. Thus, machine 10 and coin box 12 are arranged to accept reversible insertion of the latter into the former. Simultaneously, electrodes 50, 52, and their corresponding electrodes 54, 56 of projection 60 are linearly alignable regardless of directional orientation of coin box 12 within machine 10, and will come into operative proximity when coin box 12 attains its predetermined position within operated machine 10.

FIG. 4 shows a preferred configuration of coin box 12 wherein upwardly projecting lateral walls of receptacle 43 are inclined such that the top of receptacle 43 is wider than the bottom thereof, and all internal surfaces are continuous and lack cracks and crevices which could otherwise trap or conceal coins. This view also shows the close cooperation between projection 60 and surface 68, and the arrangement of memory device 44 and contact 50 within panel 64.

The arrangement of contacting electrodes 50, 52, 54, 56 may be replaced by electrodes featuring non-contacting communication. As shown in FIG. 5, coin box 12 may be provided with an induction coil 74 embedded within panel 64 and connected to memory device 44. Machine 10 has a corresponding induction coil 76 embedded within projection 60, which coil 76 communicates with memory device 34 (see FIG. 2) through circuitry 48. Even though physical contact is absent, operative proximity enables coils 74 and 76 to transmit signals to one another.

Obviously, one of coils 74 or 76 may be replaced by a metal structure the form of which is not critical, in order to react appropriately with the electromagnetic field, depending upon the desired direction of communication. Where a coil 74 or 76 is provided, it will be understood to include a suitable power supply (not shown). The use of inductive coils for communicating signals is conventional, and these coils are shown only in representative capacity in FIG. 5.

Another form of electrodes providing non-contact communication is shown in FIG. 6. Coin box 12 has a radio frequency transmitter and receiver 78 and an associated antenna 80. Of course, transmitter and receiver 78 is connected to memory device 44, although not shown in FIG. 6. Machine 10 has a corresponding radio frequency transmitter and receiver 82 having a respective associated antenna 84. The respective devices indicated as 78 and 82 may, of course, comprise only a transmitter or only a receiver, depending upon the desired scheme of communication. In the embodiments of FIGS. 5 and 6, signal strength will be predetermined so that communication is established only when a predetermined proximity between the communicating elements is attained.

Variations and modifications to the invention may be introduced by those of skill in the art. For example, coin box 12 may be modified so that the front and rear sections of wall 66 enable sliding of coin box 12 on projection 60. Other structure (not shown) may be provided for supporting coin box 12 as it is slid into and out of its operative position within machine 10. Although electronic data handling has been described, optical and other systems may be substituted in whole or in part to similar effect.

It is to be understood that the present invention is not limited to the embodiments described above, but encompasses any and all embodiments within the scope of the following claims.

I claim:

1. A coin operated machine having a removably insertable coin box for receiving and storing coins inserted into said coin operated machine, comprising:

apparatus for accepting coins, performing a function responsive to a coin being accepted, a first memory device and first circuitry for transmitting communication signals from said first memory device, and receiving structure for removably receiving a coin box within said coin operated machine; and a coin box having a receptacle for receiving and storing coins inserted into said coin operated machine, guiding structure for guiding said coin box into a predetermined position within said receiving structure of said coin operated machine, a second memory device and second circuitry for transmitting communication signals between said second memory device and said first circuitry, said receiving structure comprising a cavity having a floor and a projection having a first inclined lateral wall disposed upon said floor and projecting upwardly from said floor, said guiding structure of said coin box comprising a bottom wall, a depending wall depending from said bottom wall and having a second inclined wall complementing and closely cooperating with said projection, whereby lowering said coin box onto said floor of said cavity of said receiving structure causes said coin box to attain said predetermined position within said coin operated machine.

2. The coin operated machine according to claim 1, said projection being tapered and smaller at the top thereof than at the bottom thereof, and said second inclined surface being accordingly tapered such that lowering said coin box onto said floor of said cavity of said coin operated machine causes said coin box to become centered over said projection.

3. The coin operated machine according to claim 1, said first circuitry comprising first electrodes mounted within said projection, and said second circuitry comprising corresponding, linearly alignable second electrodes mounted within said coin box at said bottom panel, said first electrodes and said second electrodes coming into operative proximity when said coin box attains said predetermined position within said coin operated machine.

4. The coin operated machine according to claim 3, said first electrodes being exposed from above said projection of said cavity of said coin operated machine and said second electrodes being exposed from below said bottom panel of said coin box and disposed to make physical contact with said first electrodes when said coin box attains said predetermined position within said coin operated machine.

5. The coin operated machine according to claim 4, said first electrodes being disposed to make sliding contact with said second electrodes when said coin box attains said predetermined position within said coin operated machine, said first electrodes and said second electrodes being arranged serially with respect to the direction of insertion of said coin box into said coin operated machine, whereby contact between said first electrodes and said second electrodes is preserved regardless of whether said coin box is inserted into said coin operated machine in a first directional orientation or in a second directional orientation.

6. The coin operated machine according to claim 3, said first electrodes being induction coils and said second electrodes being corresponding induction coils, whereby said first circuitry may transmit communication signals to said second circuitry in the absence of physical contact between said first electrodes and said second electrodes.

7. The coin operated machine according to claim 3, said first electrodes and said second electrodes including a transmitter and antenna and a receiver for respectively transmitting and receiving radio frequency signals, whereby said first circuitry may transmit communication signals to said second circuitry in the absence of physical contact between said first electrodes and said second electrodes.

8. The coin operated machine according to claim 1, said receptacle of said coin box having a top, a bottom and inclined upwardly projecting lateral walls, whereby said receptacle is wider at said top than at said bottom.

9. A coin operated machine having a removably insertable coin box for receiving and storing coins inserted into said coin operated machine, comprising:

apparatus for accepting coins, performing a function responsive to a coin being accepted, a first memory device and first circuitry for transmitting communication signals from said first memory device, and receiving structure for removably receiving a coin box within said coin operated machine; and a coin box having a receptacle for receiving and storing coins inserted into said coin operated machine, guiding structure for guiding said coin box into a predetermined position within said receiving structure of said coin operated machine, said guiding structure of said coin box comprising a bottom wall, a depending wall depending from said bottom wall and having a second inclined surface complementing and closely cooperating with said projection, whereby lowering said coin box onto said floor of said cavity of said receiving structure causes said coin box to attain said predetermined position within said coin operated machine; and a second memory device and second circuitry for transmitting communication signals between said second memory device and said first circuitry, said first circuitry comprising first electrodes mounted within said projection, and said second circuitry comprising corresponding, linearly alignable second electrodes mounted within said coin box at said bottom panel, said first electrodes and said second electrodes coming into operative proximity when said coin box attains said predetermined position within said coin operated machine, said receiving structure comprising a cavity having a floor and a projection having a first inclined lateral wall disposed upon said floor and projecting upwardly from said floor, said projection being tapered and smaller at the top thereof than at the bottom thereof, and said second inclined surface being accordingly tapered such that lowering said coin box onto said floor of said cavity of said coin operated machine causes said coin box to become centered over said projection.

10. A gaming machine having a removably insertable coin box for receiving and storing coins inserted into said gaming machine, comprising:

a gaming machine having means for accepting coins, calculating a random chance result responsive to a coin being accepted, and dispensing a return based on said chance result, a first memory device and first circuitry for transmitting communication signals between said first memory device and an external data processor, and receiving structure for removably receiving a coin box within said gaming machine, said receiving structure comprising a cavity having a floor and a projection having a first tapered lateral wall disposed upon said floor and projecting upwardly from said floor; and a coin box having a receptacle for receiving and storing coins inserted into said gaming machine, guiding structure for guiding said coin box into a predetermined position within said receiving structure of said gaming machine, where said guiding structure comprises a bottom wall, a depending wall depending from said bottom wall and having a second tapered surface complementing and closely cooperating with said tapered lateral wall of said projection, a second memory device and second circuitry for transmitting communication signals between said second memory device and said first circuitry; and whereby lowering said coin box onto said floor of said cavity of said receiving structure causes said coin box to attain said predetermined position within said gaming machine.

11. The gaming machine according to claim 10, said first circuitry comprising first electrodes mounted within said projection, and said second circuitry comprising corresponding, linearly alignable second electrodes mounted within said coin box at said bottom panel, said first electrodes and said second electrodes coming into operative proximity when said coin box attains said predetermined position within said gaming machine.

12. The gaming machine according to claim 11, said first electrodes being exposed from above said projection of said cavity of said gaming machine and said second electrodes being exposed from below said bottom panel of said coin box and disposed to make physical contact with said first electrodes when said coin box attains said predetermined position within said gaming machine.

13. The gaming machine according to claim 12, said first electrodes being disposed to make sliding contact with said second electrodes when said coin box attains said predetermined position within said gaming machine, said first electrodes and said second electrodes being arranged serially with respect to the direction of insertion of said coin box into said gaming machine, whereby contact between said first electrodes and said second electrodes is preserved regardless of whether said coin box is inserted into said gaming machine in a first directional orientation or in a second directional orientation.

14. The gaming machine according to claim 11, said first electrodes being induction coils and said second electrodes being corresponding induction coils, whereby said first circuitry may transmit communication signals to said second circuitry in the absence of physical contact between said first electrodes and said second electrodes.

15. The gaming machine according to claim 11, said first electrodes and said second electrodes including a transmitter and antenna and a receiver for respectively transmitting and receiving radio frequency signals, whereby said first circuitry may transmit communication signals to said second circuitry in the absence of physical contact between said first electrodes and said second electrodes.

* * * * *